US006244522B1

(12) United States Patent
Reighard et al.

(10) Patent No.: US 6,244,522 B1
(45) Date of Patent: Jun. 12, 2001

(54) NOZZLE ASSEMBLY FOR DISPENSING HEAD

(75) Inventors: Michael A. Reighard, Avon Lake; David M. Selestak, Avon, both of OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/309,656

(22) Filed: May 10, 1999

(51) Int. Cl.[7] ..... B05B 1/28; B05B 1/00

(52) U.S. Cl. ..... 239/290; 239/600

(58) Field of Search ..... 239/405, 600, 239/406, 424.5, 290, 296; 285/345, 346, 347, 349

(56) References Cited

U.S. PATENT DOCUMENTS

| | | | | |
|---|---|---|---|---|
| 3,521,824 | * | 7/1970 | Wilcox | 239/424.5 |
| 4,753,819 | | 6/1988 | Shimada | 427/96 |
| 4,880,663 | | 11/1989 | Shimada | 427/96 |
| 4,925,101 | * | 5/1990 | Konieczynski et al. | 239/526 |
| 5,180,104 | * | 1/1993 | Mellette | 239/300 |
| 5,188,290 | * | 2/1993 | Gebauer et al. | 239/708 |
| 5,292,068 | | 3/1994 | Raterman . | |
| 5,336,320 | | 8/1994 | Hogan et al. | 118/300 |
| 5,368,233 | * | 11/1994 | Brusko | 239/290 |
| 5,409,733 | | 4/1995 | Boger et al. | 427/96 |
| 5,421,522 | * | 6/1995 | Bowen | 239/600 |

FOREIGN PATENT DOCUMENTS 0 417 815 A1 3/1991 (WO) .

OTHER PUBLICATIONS

International Search Report relating to International Application No. PCT/US00/12641.

* cited by examiner

*Primary Examiner*—Andres Kashnikow
*Assistant Examiner*—Davis Hwu
(74) *Attorney, Agent, or Firm*—Calfee, Halter & Griswold LLP

(57) ABSTRACT

A dispensing head for air assisted and airless application of a material to a surface includes a cylindrical barrel having a supply passage therein for the material to flow from a source to a nozzle. The barrel includes at one end a nozzle seat that slideably receives a nozzle body. The nozzle body has a bore that opens at one end to the barrel passageway, and at another end has a nozzle tip with an orifice through which material is dispensed. The nozzle body has a groove formed therein that receives a seal. When the nozzle body is inserted into the nozzle seat, the seal is compressed between the nozzle groove wall and a wall of the nozzle seat to hold the nozzle within the nozzle seat during further assembly of the dispensing head. The seal is preferably captured and isolated from a set of air jets that are formed in the nozzle body, thereby preventing the seal for blocking the air jets.

12 Claims, 5 Drawing Sheets

NOZZLE ASSEMBLY FOR DISPENSING HEAD

TECHNICAL FIELD OF THE INVENTION

The invention relates generally to spray apparatus for selective application of materials to objects, for example, the application of conformal coating to a printed circuit board. More specifically, the invention relates to an improved nozzle assembly for a dispensing head used in such spray apparatus.

BACKGROUND OF THE INVENTION

Printed circuit boards with electrical components mounted thereon are typically coated by a moisture resistant, electrically insulating film. Such films are generally known as conformal coatings, such as silicone, polyurethane, acrylic or epoxy resins. Conformal coatings play an important role in protecting circuit board components from moisture, dust and other contaminants that can adversely affect component performance. Since some components and contacts on a circuit board must remain uncoated, selective coating techniques have been developed. Traditional methods such as standard spray apparatus, brushing and dipping are not suitable for accurate selective application of conformal coatings. Such known systems typically involve a substantial amount of masking and unmasking which is very labor intensive and can lead to extensive rework.

Recently, a new robotically controlled conformal coating application system has been introduced by Nordson Corporation of Westlake, Ohio. This system is sold under the name of the SELECT COAT® spraying system. This system and components thereof are described in the following U.S. Pat. Nos. 4,753,819; 4,880,663; 5,336,320; and 5,409,733; the entire disclosures of which are fully incorporated herein by reference. In general, a selective coating apparatus such as the SELECT COAT® spraying system uses an electronic control system to control the operation of a robot-based dispensing unit. The control system controls operation of a robot mechanism for positioning a dispensing head relative to the circuit board and the specific locations thereon where the coating material is to be applied. The control system also controls operation of the dispensing unit to selectively open and close a control valve at the appropriate times to apply coating material to the circuit board. Such systems can be self-contained stand-alone workstations, or alternatively can be integrated into a conveyorized continuous process production line to accommodate high volume operations, including in-line curing ovens.

The dispensing head is an important part of the overall spraying apparatus because the dispensing head shapes the spray pattern of the coating material that is directed to the circuit board. Dispensing options include but are not limited to nonatomizing methods which are typically used with low viscosity coating material (under 100 centipoise, for example) and air assisted atomizing methods for higher viscosity coating materials (for example, 100–3,500 centipoise).

The Nordson SELECT COAT® spraying system further includes the capability for SWIRL COAT™ spray application technology of conformal coating material to a circuit board. The SWIRL COAT™ spraying method and apparatus are described in co-pending U.S. patent applications Ser. No. 08/687,790 filed on Jul. 19, 1996, now abandoned, and a continuation-in-part thereof, Ser. No. 08/878,756 filed on Jun. 19, 1997, which applications are both owned in common by the assignee of the present invention, the entire disclosures of which are fully incorporated herein by reference. The referenced applications describe a dispensing head that incorporates a single nozzle design for a plurality of dispensing options. The dispensing options include, but need not be limited to, bead mode dispensing, monofilament mode dispensing and swirl mode dispensing. The apparatus is useful with low viscosity material, high viscosity material and solid materials. Bead mode is generally an airless spray technique, while monofilament and swirl modes utilize an air stream directed at the material stream to impart rotation.

The present invention is directed to improvements in the dispensing head and nozzle configuration for not only the SWIRL COAT™ dispensing head used with the SELECT COAT® spraying system, but for any spray dispensing head that utilizes a twopiece spray nozzle, to improve ease of assembly and maintenance.

SUMMARY OF THE INVENTION

To the accomplishment of the foregoing objectives, and in accordance with one embodiment of the invention, a dispensing head for air assisted and airless application of a material to a surface includes a cylindrical barrel having a material or fluid supply passage therein for the material to flow from a source to a nozzle. The barrel includes at one end a nozzle seat that slideably receives a nozzle body. The nozzle body has a bore that opens at one end to the supply passageway. The bore opens at an opposite end to a nozzle tip having an orifice through which material is dispensed. In accordance with one aspect of the invention, the nozzle body has a groove formed therein that retains a seal. When the nozzle body is inserted into the nozzle seat, the seal is compressed between the nozzle and a wall of the nozzle seat to hold the nozzle within the seat during further assembly of the dispensing head.

In accordance with another aspect of the invention, the dispensing head includes a second cylindrical barrel that is mounted about the first barrel and includes a flange or shoulder that engages and secures the nozzle in the nozzle seat.

In accordance with another aspect of the invention, the seal may be realized in the form of an annular seal, for example, an o-ring type seal, that is retained in a groove formed in a stem of the nozzle body and that produces a frictional engagement with a wall of the nozzle seat to retain the nozzle in the seat during assembly. This permits the nozzle to be retained in the seat even against the force of gravity when the dispensing head is in a vertical position during assembly. This frictional retention also helps maintain proper alignment of the nozzle in the barrel while the nozzle is secured to the barrel.

Still further, the annular seal functions as a seal that blocks air from entering into the fluid supply passageway of the barrel. The seal, by being positioned within the nozzle seat, isolates or separates the fluid material from the nozzle air jets or orifices used to impart air to the material dispensed from the nozzle tip for air assisted spraying modes. In this manner, seal material will not extrude or otherwise block the air jets.

These and other aspects and advantages of the present invention will be apparent to those skilled in the art from the following description of the preferred embodiments in view of the accompanying drawings.

BRIEF DESCRIPTION OF THE DRAWINGS

The invention may take physical form in certain parts and arrangements of parts, preferred embodiments and a method of which will be described in detail in this specification and illustrated in the accompanying drawings which form a part hereof, and wherein.

DETAILED DESCRIPTION OF THE PREFERRED EMBODIMENTS

Figure 1:
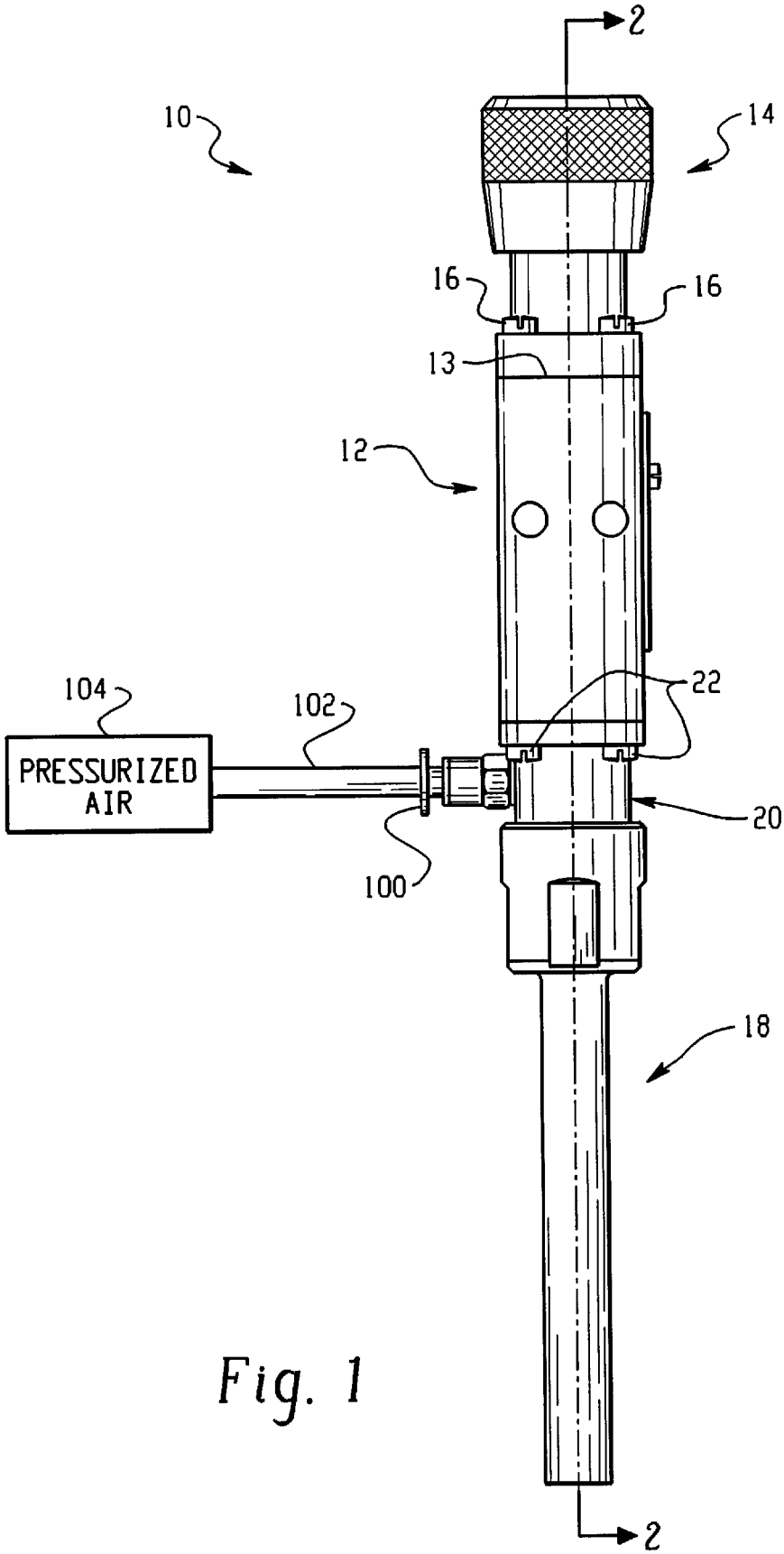
FIG. 1 is a dispensing head in elevation, suitable for use with the present invention.

With reference to FIG. 1, a dispensing head 10 is illustrated such as can be used with the concepts of the present invention. Although the invention and preferred embodiments thereof are described herein with reference to a specific type of dispensing head 10 used for the application and spraying of conformal coating onto a circuit board, such description is for explanation only and should not be construed in a limiting sense. The present invention finds application generally with any dispensing head that uses a separate nozzle body and nozzle seat.

The dispensing head 10 can be, for example, part no. 226315 available from Nordson Corporation of Amherst, Ohio. Except for specifics of the nozzle assembly as described hereinafter, the design and operation of the dispensing head 10 is fully described in the above incorporated U.S. Pat. No. 5,336,320 (hereafter the "'320 patent") and reference can be made thereto for such description. The dispensing head 10 of the present invention is somewhat modified from the dispensing head described in the '320 patent and such differences will be described herein. In general, the dispensing head 10 of the present invention includes a supply for air in order to be able to effect an air assisted spray pattern, although the dispensing head 10 of the present invention can also operate in an airless mode.

The dispensing head 10 includes a main dispenser body 12 which at a first end 13 thereof has a valve plunger return and adjustment mechanism 14 that is mounted on the main body 12 by bolts 16. Design and operation of the mechanism 14 is fully set forth in the '320 patent and need not be repeated herein. A barrel assembly 18 includes a sleeve 20 that is mounted on the main body 12 opposite the first end 13 by bolts 22. The barrel assembly 18 includes a nozzle and nozzle seat, as well as inner and outer barrels or tubes, as will be further explained in connection with FIG. 2.

Figure 2:
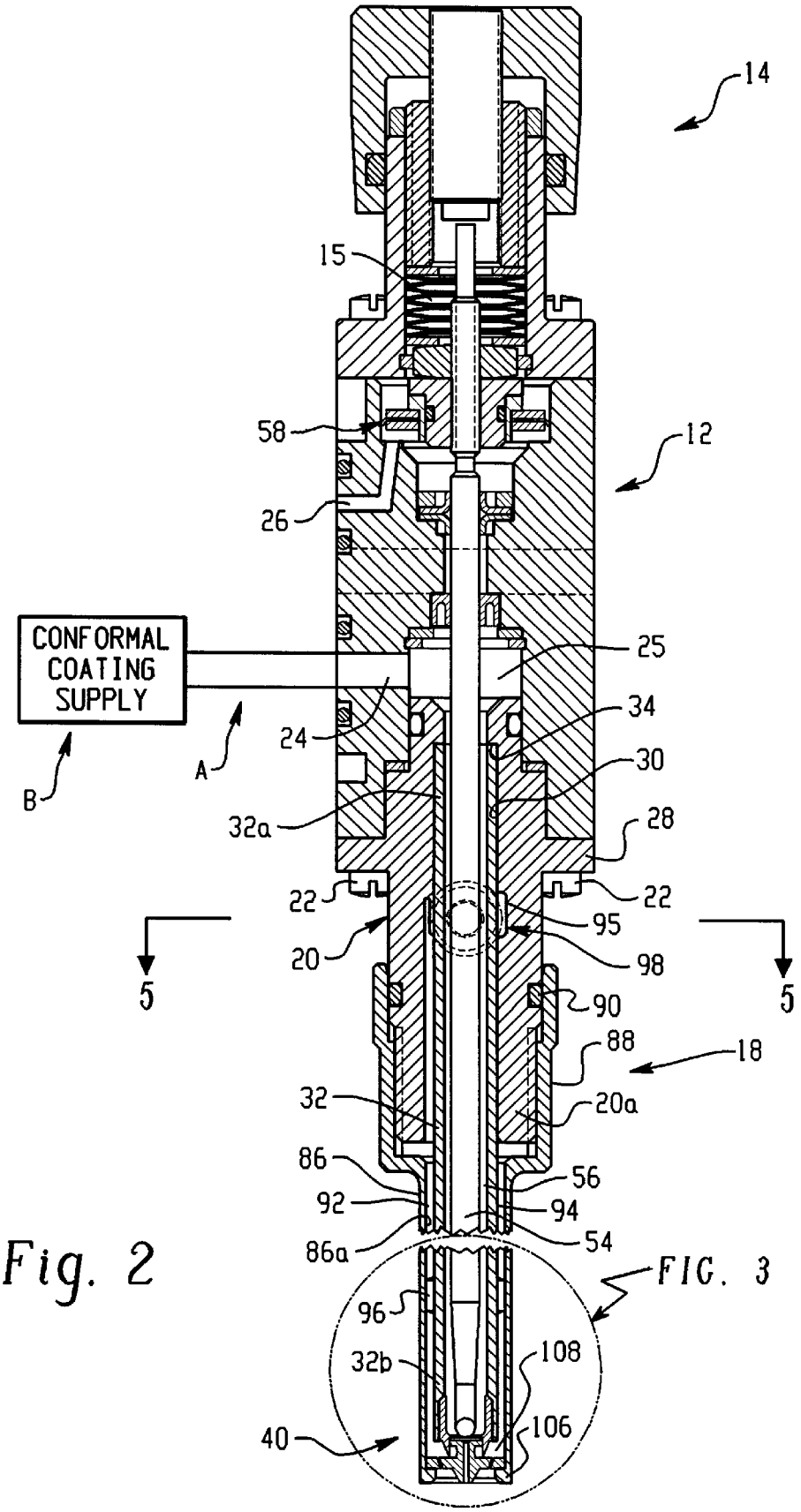
FIG. 2 is the dispensing head of FIG. 1 in longitudinal cross-section along the line A—A in FIG. 1.

With reference next to FIG. 2, the dispensing head 10 is shown in longitudinal cross-section. When comparing FIG. 2 to the disclosure in the '320 patent it should be noted that in the present invention the main body 12 is one piece, whereas in the '320 patent the main body includes two modules. Either embodiment is suitable for the dispensing head. Additionally, a manifold for connecting the dispensing head 10 to a source of the coating material and to a source of pressurized air for actuating the plunger mechanism 14 is omitted from the drawings herein for clarity. The '320 patent fully describes the manifold and its operation and reference may be made thereto for additional details. Still further, the exemplary embodiment of the present invention does not include the re-circulation feature described in the '320 patent, however, such a feature may be used with the present invention if so required for a particular application.

For purposes of the present invention, it is sufficient to note that the coating material is introduced into the dispensing head 10 via an inlet port 24, and actuating pressurized air is introduced into the mechanism 14 via an air port 26. The coating material passes into a cavity 25 and then down into a feed bore as will be described hereinafter. A supply hose A is connected at one end to the port 24 by any suitable fitting (not shown) as is well known in the art, and at the other end to a supply B of the material being dispensed, in this exemplary embodiment liquid conformal coating material; however, those of ordinary skill in the art will readily understand and appreciate that the present invention is not limited to dispensing conformal coating but may be used in connection with dispensing any fluid suitable for use with the overall dispensing apparatus.

The present invention is more particularly directed to the barrel assembly 18. With continued reference to FIG. 2, this assembly 18 includes the sleeve 20 having a flange 28 for mounting the sleeve 20 on the main body 12 via bolts 22. The sleeve 20 has a central bore 30 that receives a first end (32*a*) of a first or inner barrel or material feed tube 32. The inner barrel 32 slides up into the sleeve 20 and bottoms on a counterbore shoulder 34 thereof. The inner barrel 32 extends to an opposite nozzle seat end 32*b*.

Figure 3:
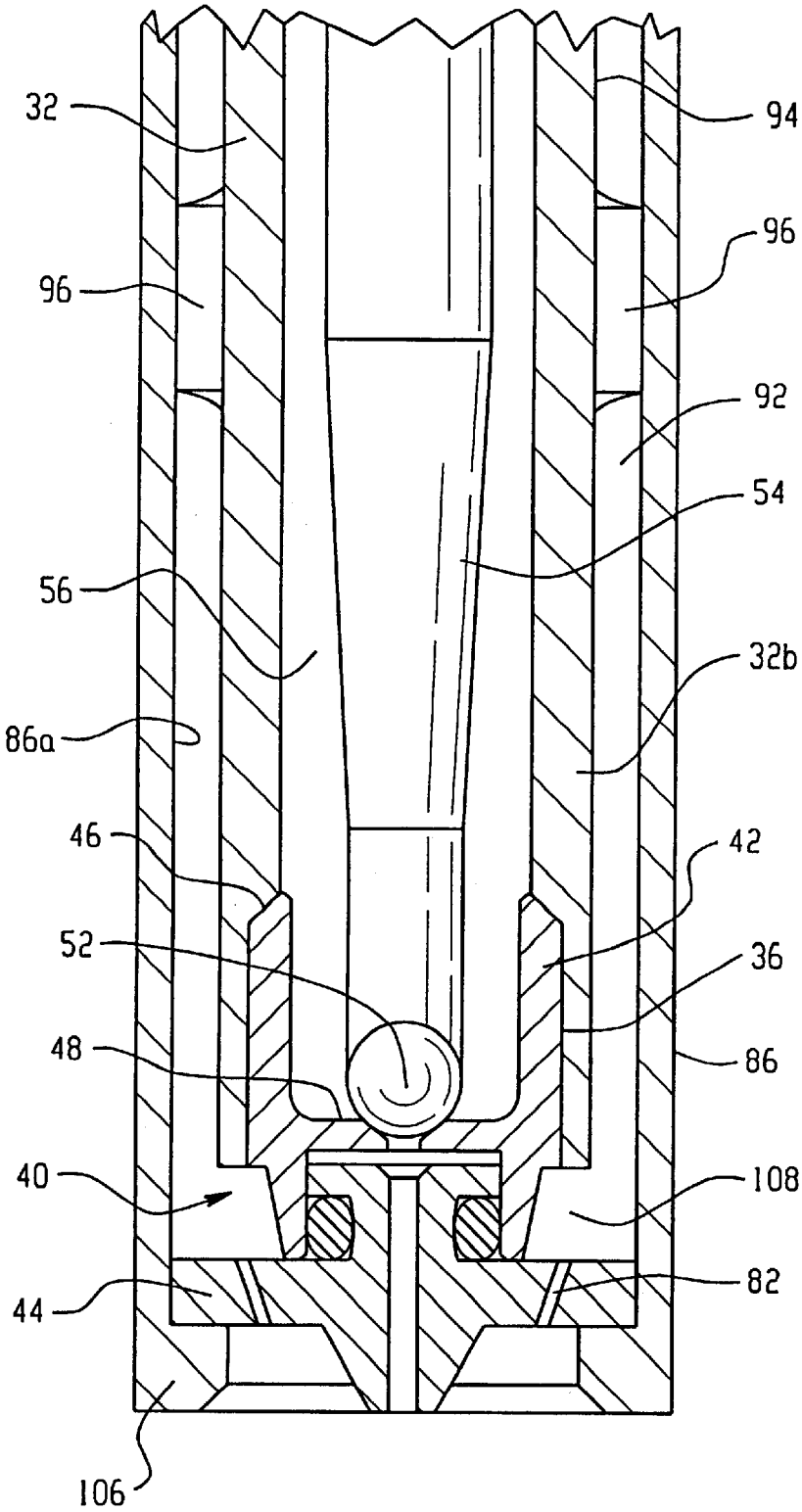
FIG. 3 illustrates in an enlarged view and in cross-section the region within the dotted circle of FIG. 2.

With reference also to FIG. 3, the nozzle end 32*b* of the inner barrel 32 has a nozzle seat recess 36 formed therein. In this embodiment, the recess 36 is in the form of a counterbore, however, the barrel 32 can be provided with any configuration that is suitable for retaining a nozzle seat, or the seat could be integrally formed therewith, for example.

In this exemplary embodiment, the dispensing head 10 includes a two piece nozzle assembly 40. The nozzle assembly 40 includes a nozzle seat 42 and a discharge nozzle 44. The nozzle seat 42 is received in the recess 36 and is inserted until the seat 42 engages a shoulder 46 where it is brazed or otherwise secured in place. The nozzle seat 42 is preferably made of a suitable hard material, such as, for example, carbide. However, other materials for the seat 42 may be used as required depending on the type of material being dispensed and the type of valve used to control flow of the material. Other suitable materials include but are not limited to tool steel, ceramics and so on to name a few examples.

Figure 4A:
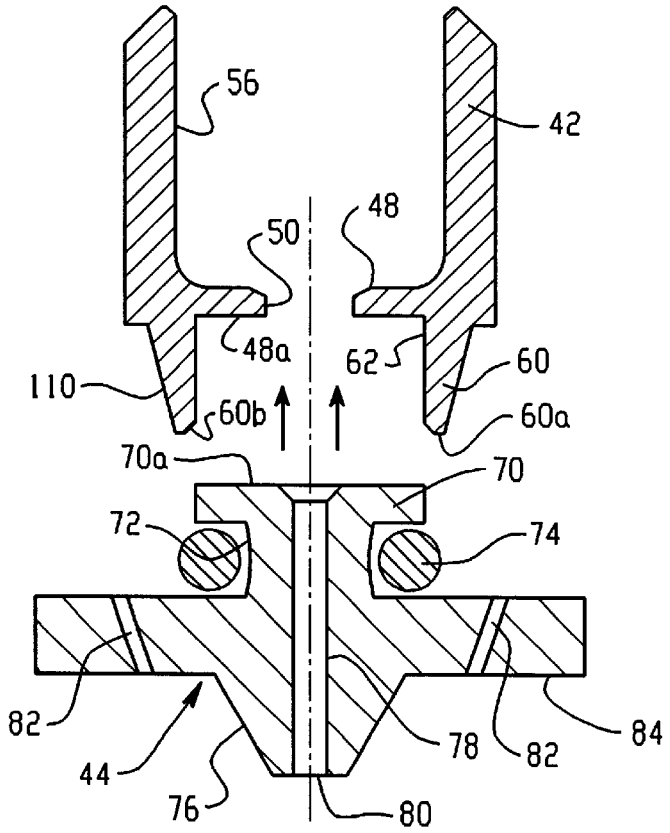
FIGS. 4A and 4B illustrate in a simplified view in cross-section a nozzle assembly in accordance with the invention in an unassembled condition (FIG. 3A) and after assembly (FIG. 3B)

With additional reference to FIG. 4A, the nozzle seat 42 is generally a cylindrical structure with an inwardly extending seat wall 48 having a central flow port 50 formed therethrough. The port 50 is opened and closed by a valve member 52, which can be realized in the form of a ball tip carried at an end of a valve plunger 54. Other valve designs may be used as required for a particular application, for example, a needle valve configuration may be used to name just one example.

The plunger 54 is disposed within a central feed bore 56 of the inner barrel 32. The plunger 54 is appropriately dimensioned so that there is sufficient space for coating material to flow from the cavity 25, down the barrel 32 to the nozzle assembly 40. The coating material thus flows down the inner barrel 32 through the bore 56 along the outside of the plunger 54. When the plunger 54 is retracted (not shown), the ball tip unseats from the seat wall 48 to open the port 50, thus permitting material to flow through the port 50 to the discharge nozzle 44.

The plunger 54 is operatively connected to the plunger retracting assembly 14 in a manner as described in the '320 patent. The assembly 14 includes a mechanism for biasing the plunger to a closed position such as is illustrated in FIG. 2 hereof. In this embodiment, a spring assembly 15 is used to bias the valve 52 closed. To open the valve 40, pressurized air is supplied to the port 26 and acts on an air piston assembly 58 to retract the plunger 54 which is operatively coupled to the piston, the details of which are fully described in the '320 patent.

With continued reference to FIGS. 2 and 4A, the nozzle seat 42 includes a cylindrical extension 60 with a counterbore recess 62 formed therein. This recess 62 closely receives a central annular nozzle body stem 70 of the discharge nozzle 44. The stem 70 has a seal groove 72 formed therein. A seal 74 is disposed on the stem 70 in the groove 72. The seal 74 preferably is retained within the groove 72 sufficiently so as not to be dislodged when the nozzle stem 70 is inserted into the nozzle seat recess 62. In this embodiment, the seal 74 is realized in the form of an o-ring made of any suitable material that is compatible with the material being dispensed, in this case a conformal coating material. For example, the seal 74 can be made of KALREZ® available from DuPont Dow Elastomers, for example. Other seal configurations besides an o-ring can be used as appropriate, for example, a quad-ring may be used.

The discharge nozzle 44 further includes a tapered central tip 76 through which material is dispensed toward a target such as a printed circuit board (not shown). A central dispensing bore 78 extends through the nozzle 44 from the stem 70 to the tip 76. Material flowing from the port 50 when the valve 52 opens is thus discharged through an outlet spray orifice 80.

The nozzle 44 also includes air jets 82 formed in an annular flange 84. The air jets 82 may be realized in the form of individual bores formed through the flange 84 as illustrated. Preferably, the jets 82 are precisely angled so as to direct air towards the material exiting the orifice 80 to impart a swirling motion to the material flow pattern. This swirling motion is in the nature of a tornadic swirling motion to effect a thorough yet highly selective and controlled application of the conformal coating material on the target. The jets 82 are radially disposed outward of the seat extension 60 so as to be open to a cavity that surrounds the outside of the nozzle seat 42 as will be further described hereinafter.

Figure 4B:
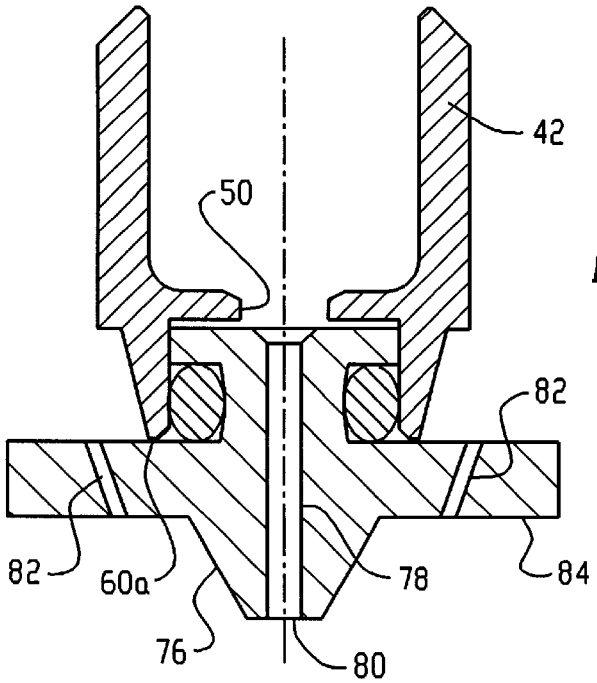

FIG. 4B illustrates the nozzle 44 fully inserted and seated in the nozzle seat 42. Note that the seal 74 is appropriately dimensioned so that it engages the counterbore 62 wall when the stem is seated therein. The seal 74 preferably is compressed between the counterbore 62 wall and the stem groove 72 wall as illustrated. The seal 74 thus seals against material escaping from the nozzle assembly 40 around the stem 70, and also prevents air from passing up into the feed bore 56. In other words, the seal 74 separates the fluid material section or bore 56 from the air section or passage 92. In accordance with a further aspect of the invention, the seal 74 is substantially captured, encapsulated and isolated within the groove 72 after the stem 70 is fully seated in the recess 62. This helps reduce the possibility of the seal 74 extruding towards and obstructing the air jets 82. Preferably, but not necessarily, the flange 84 bottoms against the lower wall 60*a* of the seat extension 60 before the stem 70 upper wall 70*a* bottoms against the lower wall surface 48*a* of the seat wall 48. The nozzle 44 can be inserted into the seat 42 by pushing the nozzle 44 up into the recess 62 with a slight twisting motion. The seat extension 60 may be chamfered as at 60*b* to help guide the nozzle stem 70 into the recess 62 and to reduce the occurrence of damaging the seal 74 during assembly.

With reference again to FIGS. 2 and 3, an outer barrel or tube 86 is generally concentrically disposed about the inner barrel 32 and the nozzle assembly 40. The outer barrel 86 includes an internally threaded tubular end 88 that is screwed onto an externally threaded end 20*a* of the sleeve 20. An o-ring 90 or other suitable sealing technique is used to seal this joint against loss of pressurized air.

The outer barrel 86 is appropriately sized so as to provide an air passage 92 between the inner wall 86*a* of the barrel 86 and the outer wall 94 of the inner barrel 32. Spacers 96 may be used in this air passage 92 to maintain concentric alignment of the two barrels 32, 86 along the axial extent thereof. The spacers 96 can also be used to impart a turbulent or swirling motion to the air flow.

Figure 5:
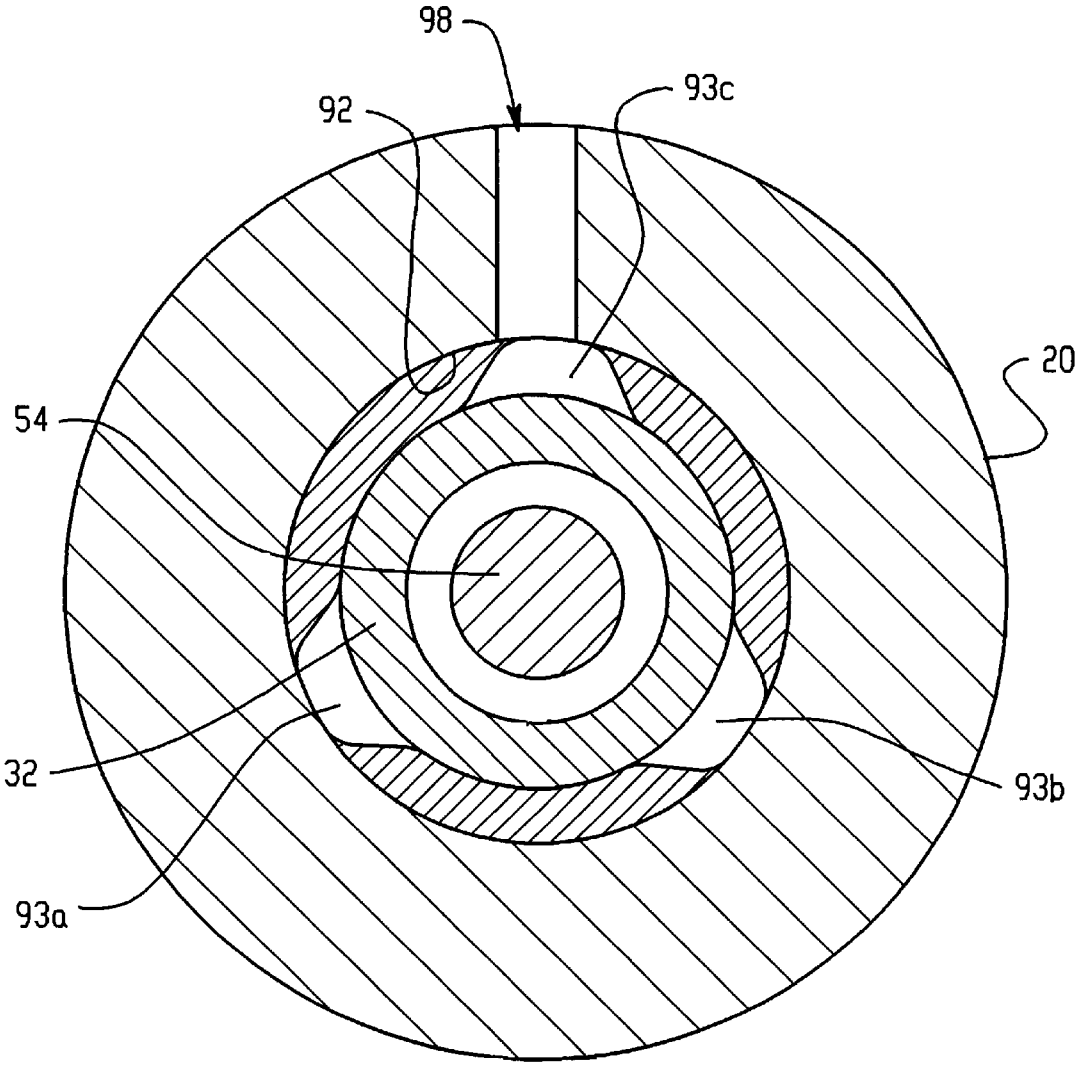
FIG. 5 illustrates a cross-section view taken along the line 5—5 in FIG. 2.

The air passage 92 is an annulus that is in fluid communication with an air inlet port 98 that is coupled to an air inlet fitting 100 (FIG. 1). The fitting 100 connects with a standard air hose (102) that feeds air from a pressurized air supply 104. The annulus 92 feeds air into three air passage lobes 93 (see 93*a*, 93*b* and 93*c* FIG. 5) which lobes extend down the outside of the inner barrel 32 to provide air to the air passage 92. In this manner, the inner barrel 32 can be press fit into the sleeve 20 while at the same time allowing air to be fed into the space between the inner and outer barrels 32, 20.

The air passage 92 opens to a preferably but not necessarily enlarged air cavity 108. The air jets 82 also open to this cavity 108. The valve seat 42 may be tapered as at 110 (FIG. 4A) to provide this enlarged air cavity. The jets 82 are preferably angled downward and radially to produce a rotating air pattern around the discharge orifice 80. As the fluid that is dispensed from the nozzle 40 enters the tornadic rotating air pattern, the fluid swirls and rotates to produce a desired spray pattern including a swirling atomized fluid spray pattern or a swirling monofilament fluid pattern As illustrated in FIGS. 2 and 3, the nozzle end of the outer barrel 86 has an inwardly extending shoulder or flange 106. This flange 106 engages the flange 84 of the nozzle 42 and securely holds the nozzle 42 in place after the outer barrel 86 is fully threaded and tightened down onto the sleeve 20. The radial extent of the outer barrel flange 106 is limited in order to prevent obstruction of the air jets 82 and to prevent interference with the swirling air flow.

It should be noted that the dispensing head 10 can be operated without air flow, in which case a bead mode of dispensing is used by producing a non-atomized stream of the coating material from the nozzle 42. Depending on the air pressure and material flow rates, a monofilament spray mode can be effected by using the air to impart a conical, looping pattern to the material stream. Control of the material flow and air flow thus can be used to effect the monofilament pattern or a swirl mode pattern having the atomized tornadic spray pattern discussed herein before. These various aspects of the different modes of spray pattern are fully set forth in the above-incorporated co-pending United States patent applications.

In accordance with another aspect of the invention, the snug engagement of the seal 74 with the seat wall 62 and the groove 72 wall serves to frictionally hold the nozzle 44 in proper alignment and keep the nozzle 44 and seat 42 together during further assembly of the dispensing head 10, even when the dispensing head 10 is held vertically. The nozzle 44 will not fall out of the nozzle seat 42. Thus the outer barrel 86 can be installed after the nozzle 42 and seat 44 are assembled, without the assembler having to hold all the parts or assemble the parts horizontally and further without losing alignment as the barrel 86 is installed and tightened down.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A dispensing head for air assisted and airless application of a material to a surface, comprising:

a first barrel having a material supply passageway therethrough to receive the material;

said first barrel having a nozzle seat at an end thereof;

a nozzle having an orifice through which material from said supply passageway is dispensed;

said nozzle having an extension closely received in a recess of said nozzle seat;

a second barrel disposed about said first barrel with an air passageway therebetween, said nozzle having an annular flange with air ports formed therein and in fluid communication with said air passageway, said second barrel comprising an inwardly extending shoulder that engages said flange to securely hold said nozzle in said nozzle seat after assembly;

and a seal disposed on said extension and engaging a wall of said recess to retain said nozzle body in said nozzle seat during assembly of the dispensing head.

2. The apparatus of claim 1 wherein said seal comprises an o-ring.

3. The apparatus of claim 1 wherein said nozzle annular flange surrounds said orifice, with said air ports formed in said flange to direct air at material flowing out said orifice.

4. The apparatus of claim 3 comprising a source of pressurized air. pressurized air being supplied to said air ports to impart a swirling motion to a material stream flowing from said orifice.

5. The apparatus of claim 4 wherein said material comprises a conformal coating that is applied to a surface.

6. The apparatus of claim 1 wherein said second barrel is threaded onto a sleeve of the dispensing head.

7. The apparatus of claim 1 wherein said seal is isolated from said air ports.

8. The apparatus of claim 1 wherein said extension comprises a groove in which said seal is enclosed after assembly.

9. The apparatus of claim 1 wherein said nozzle seat is inserted into an end of said barrel.

10. A dispensing head for air assisted and airless application of a fluid to a surface, comprising:

a first barrel having a supply passageway formed therethrough to receive a fluid;

said first barrel having a nozzle seat at an end thereof;

a nozzle body comprising a nozzle fluid passageway with an orifice through which fluid from said supply is dispensed; said nozzle body having an annular flange with air ports surrounding said orifice to direct air at fluid dispensed from said orifice;

a second barrel concentrically mounted with said first barrel to form an air passageway between said barrels with said air passageway in fluid communication with said air ports: said second barrel engaging said flange to retain said nozzle in said nozzle seat after assembly;

said nozzle body having an extension received in said nozzle seat; and a seal disposed on said extension and that retains said nozzle body in said nozzle seat during assembly; said seal being isolated from said air ports to prevent said seal from extruding and blocking said ports.

11. The apparatus of claim 10 wherein the dispensing head applies a conformed coating to a printed circuit board.

12. The apparatus of claim 10 wherein said nozzle seat is received in a recess formed at a nozzle end of said first barrel.

* * * * *